US006062456A

United States Patent [19]

Patti et al.

[11] Patent Number: 6,062,456

[45] Date of Patent: May 16, 2000

[54] STAPLE EXTRACTOR AND STAPLER COMBINATION

[76] Inventors: Mikel M. Patti, 1170 Beach La., Manahawkin, N.J. 08050; Vincent J. Archetto, 219 90th St., Sea Isle City, N.J. 08243

[21] Appl. No.: 09/339,659

[22] Filed: Jun. 24, 1999

[51] Int. Cl.[7] ..... B25C 5/02

[52] U.S. Cl. ..... 227/63; 227/134; 227/156

[58] Field of Search ..... 227/63, 120, 134, 227/156

[56] References Cited

U.S. PATENT DOCUMENTS 2,102,087 12/1937 Pankonin ..... 227/63
2,233,958 3/1941 Obstfeld et al. ..... 227/63
3,056,584 10/1962 Pankonin ..... 227/63
3,563,513 2/1971 Rubin et al. ..... 227/63
3,672,635 6/1972 Munson et al. ..... 227/63
5,183,196 2/1993 Miyashita ..... 227/63

*Primary Examiner*—Scott A. Smith
*Attorney, Agent, or Firm*—Charles I. Brodsky

[57] ABSTRACT

A one-piece staple extractor-stapler combination in which the staple extractor is secured to the shroud of a stapler in a configuration which also includes an openable compartment in the stapler shroud for the storage of staples, all in a dimensioned arrangement which effectively serves to raise the angle at which the shroud meets the palm of a user's hand in affording an enhanced ergonomic operation.

10 Claims, 6 Drawing Sheets

STAPLE EXTRACTOR AND STAPLER COMBINATION

FIELD OF THE INVENTION

This invention relates to the binding of various sheets of paper together, in general, and to a one-piece staple extractor-stapler combination, in particular.

BACKGROUND OF THE INVENTION

Extractors for the release of sheets of paper bound together by staples are well known. Staplers for the securing of these papers are equally well known. In typical use, staples commonly packaged 1000–5000 to a box, are loaded by row into the stapler, with the box then placed aside for later use; when the staples are depleted, another row is removed from the box and loaded in. When a staple which binds various sheets of paper is to be removed, the extractor is sought out for such purpose. Clearly, with the stapler at one location at a desk area, with the box of staples probably in a second area, and with the extractor in yet a third location, a resulting inconvenience of use follows, especially where the extractor has been mislaid—a common occurrence because of its relatively small size compared to that of the stapler.

OBJECTS OF THE INVENTION

It is an object of the invention, therefore, to provide a one-piece staple extractor-stapler combination.

It is an object of the invention, also, to provide such a one-piece combination which is ergonomically comfortable in use.

It is another object of the invention to provide such a staple extractor-stapler combination which additionally includes a separate storage compartment for staples to replenish a depleted supply without having to search out the box where the staples are normally kept.

SUMMARY OF THE INVENTION

As will become clear from the following description, the improvement afforded by the invention applies in the commonly used staplers of the type having a shroud, a baseplate, a head end at the shroud containing a staple trigger, a back end at the shroud coupled to the baseplate, and a magazine assembly coupled with the shroud and loaded with staples to be slidably pushed towards the head end by a tensioned coil spring included within the magazine. As will be seen, the improvement resides in configuring the shroud to have a first planar surface extending rearwardly from the head end at a height $H_1$ above the baseplate, and a second planar surface extending forwardly from the back end at a lesser height $H_2$ above the baseplate, to be then joined by a wall to the first planar surface to provide a rearwardly facing platform on the shroud. In accordance with the invention, the improvement further includes a staple extractor secured to this platform, which extends rearwardly beyond the back end of the shroud.

As will be described in detail, the improvement of the invention incorporates this shroud with first and second planar surfaces which extend in a generally horizontal direction, and in which the first planar surface extends rearwardly from the head end a length $L_1$ which is greater than the length $L_2$ by which the second planar surface extends forwardly from the back end. In a preferred construction, for example, the first surface extends rearwardly a distance substantially twice that by which the second surface extends forwardly.

In the preferred embodiment to be described, within the shroud is a further compartment, beneath a portion of the first planar surface, in which staples may be stored for future use—so as to lessen the need to search out the box of staples to replenish the stapler supply. Such preferred embodiment will be seen to include a lid which overlies the staple storage compartment, hinged for openable rotation towards the front end of the shroud—and composed, as an illustration, of a clear plastic material to allow visualization of the numbers of staples maintained within. As will also become apparent from a consideration of the following description, the dimensioned configuration of the invention is one which proves ergonomically advantageous over present designs, by causing an effective upwards slant to be given to the shroud of the stapler, in leading to a closer fit with the palm of a user's hand. An increased control of stapling action thereby follows, in allowing the palm of the hand to better apply a squeezing action for the stapler. This is to be contrasted with the more common arrangements which require an outward forcing of a user's thumb downwardly in order to effectuate the required compression when holding the bottom of the stapler device.

As will further become clear from the following description, by having this one-piece combination with the staple extractor secured to the platform of the shroud, not only is there a lessening of the need to search out the staple storage box for replenishing spent staples, but the need for locating a mislaid staple extractor is reduced as well. With the staple extractor extending rearwardly beyond the back end of the shroud, its placement will be appreciated not to interfere with the palm's action in stapling—especially when, as in the preferred embodiment of the invention, the staple extractor is located on a separate platform, below the top cover of the shroud, and closer to the baseplate of the stapler.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
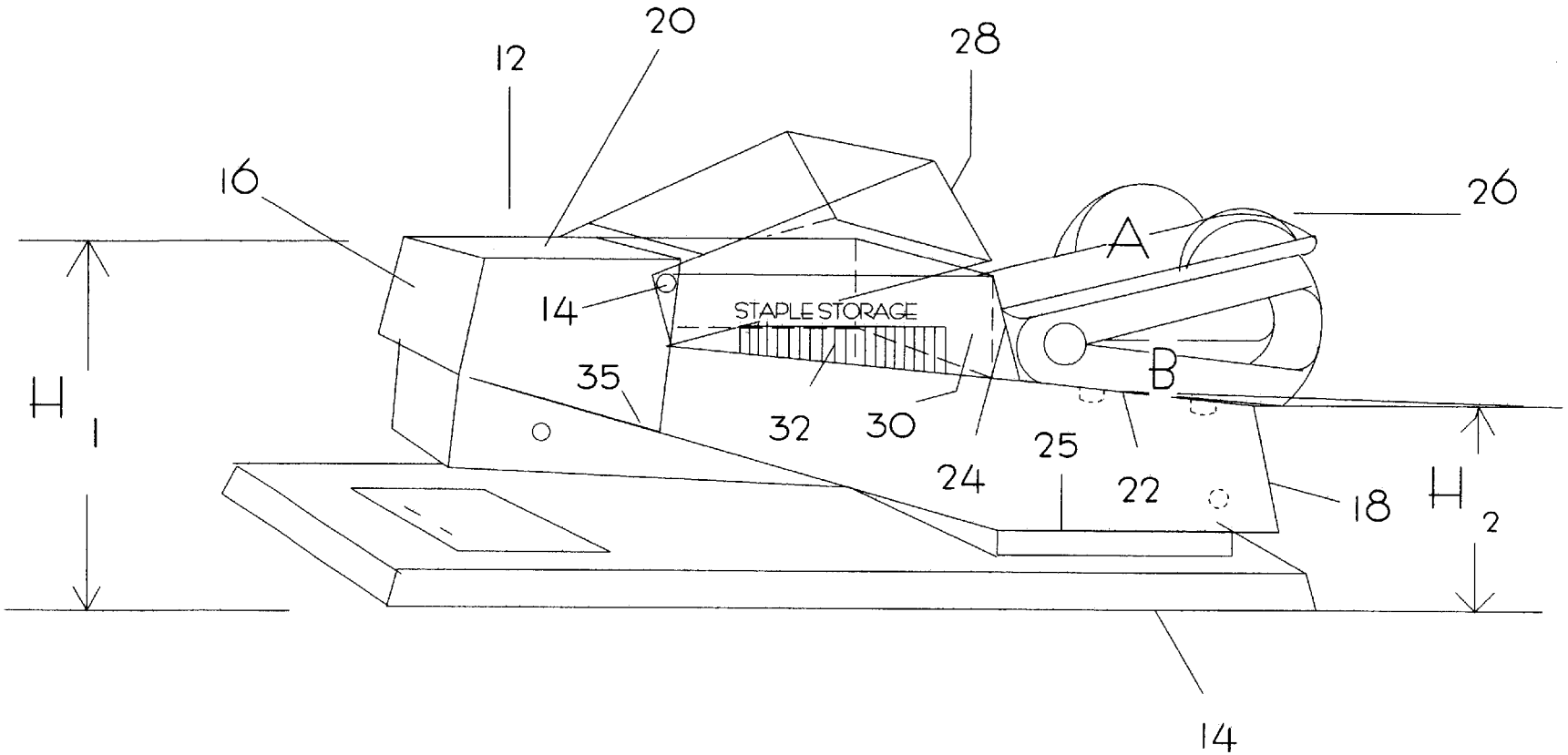
FIGS. 1–3 are perspective, top, and rear views of a one-piece staple extractor-stapler combination showing a first embodiment of the present invention, respectively.
Figure 2:
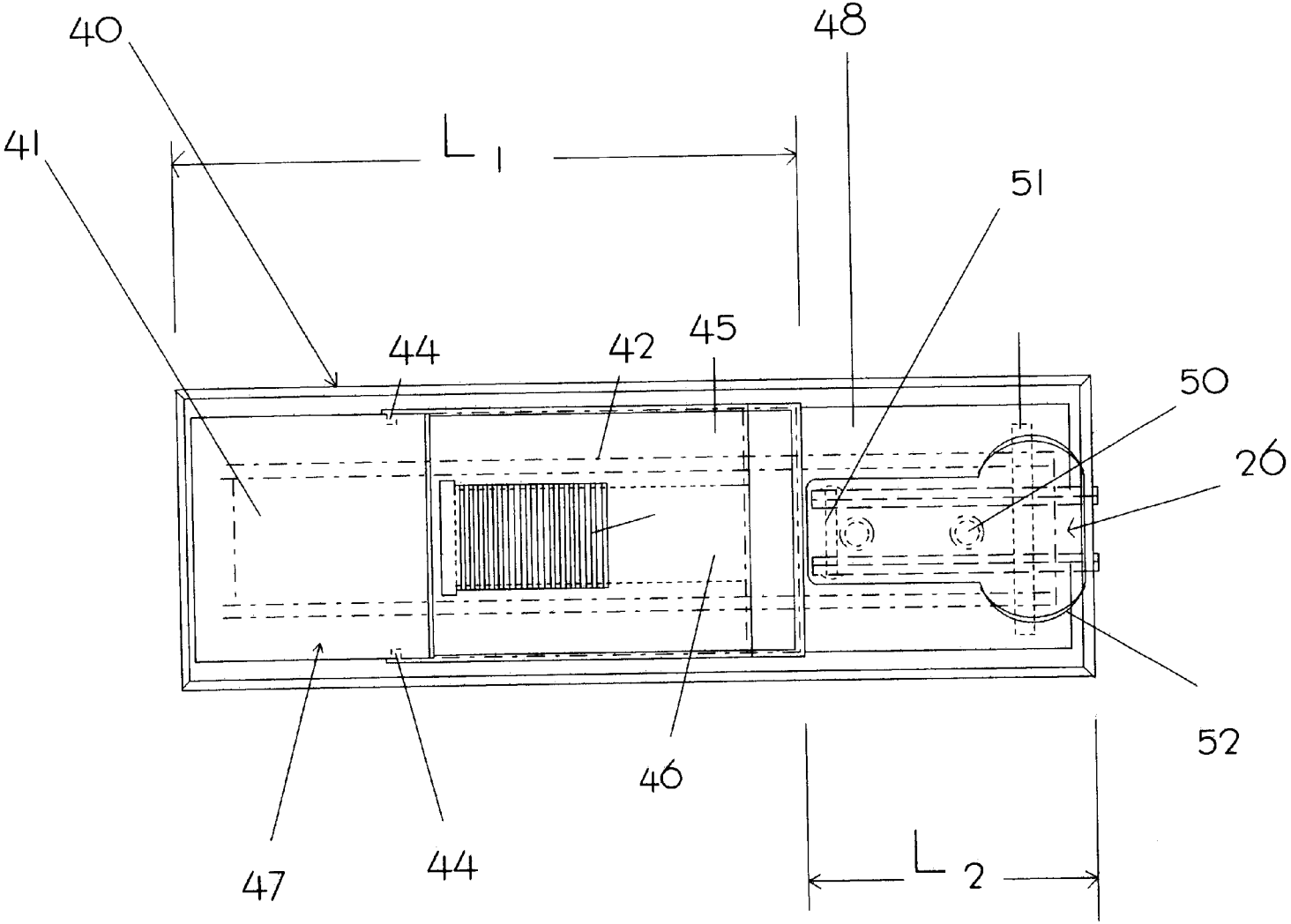
Figure 3:
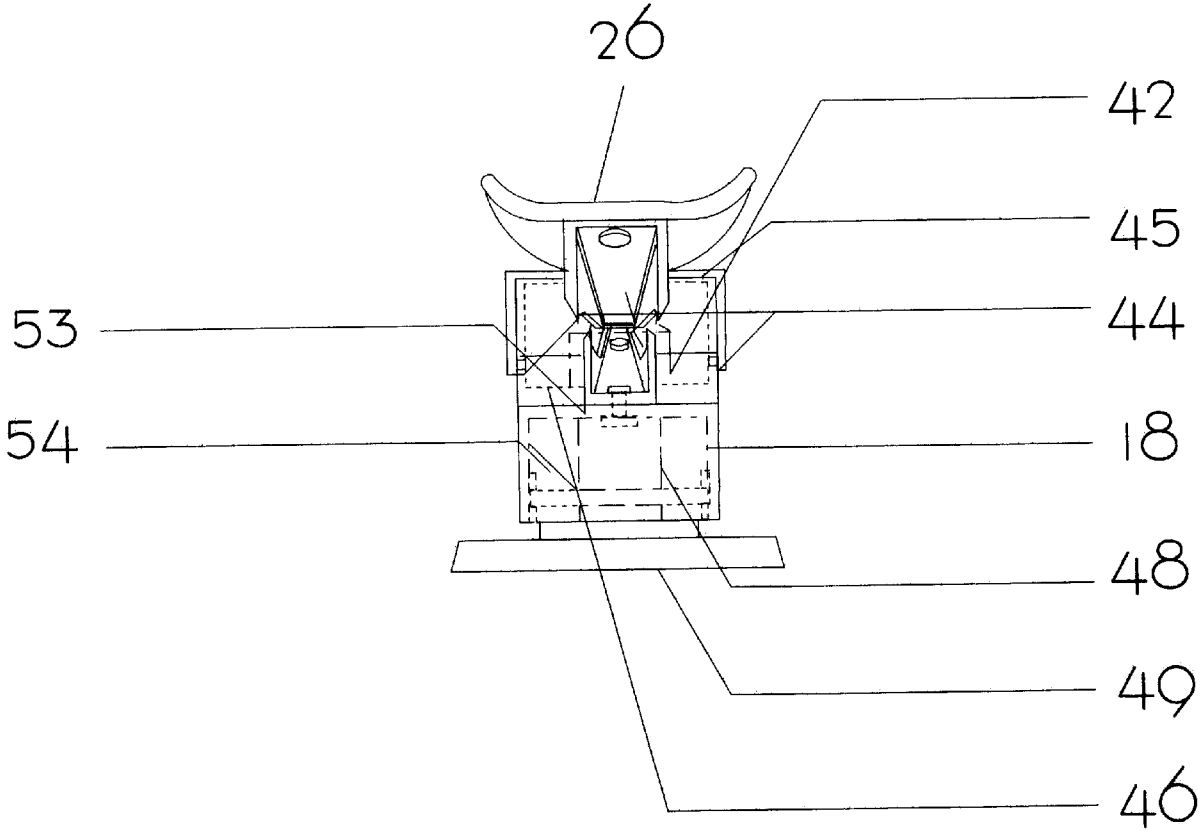

Referring to FIGS. 1–3, a typical stapler is shown, understood to be of a type having a shroud 12, a baseplate 14, a head end 16 at the shroud containing a staple trigger (not shown), a back end 18 at the shroud coupled to the baseplate, and a magazine assembly (not shown), coupled with the shroud and loaded with staples to be slidably pushed toward the head end 16 by a tension coil spring within the magazine. In accordance with the present invention, the shroud, however, differs from the typical, commonly employed stapler shroud by having a first planar surface 20 which extends rearwardly from the head end 16 at a height $H_1$ above the baseplate 14 while having a second planar surface 22 at a lesser height $H_2$ above the baseplate 14 which extends forwardly from the back end 18. A wall 24 joins the first and second planar surfaces 20, 22, in providing a rearwardly facing platform of the second planar surface, upon which a grasping-type staple extractor 26, is secured, with the platform 22 and with the extractor 26 being selected of dimension such that the staple extractor 26 extends rearwardly, beyond the back end 18 of the shroud 12.

In accordance with the invention, the first and second planar surfaces 20, 22 extend in a generally horizontal plane, joined by a generally vertical wall 24. In further accordance with this embodiment, the first planar surface 20 extends rearwardly a length $L_1$ which is greater than the length $L_2$ by which the second planar surface 22 extends forwardly of the back end 18—as, for example, twice the length.

In further accordance with the invention, the first planar surface 20 includes the lid 28 of a storage compartment 30 formed within the shroud 12, for the receipt of a supply of replenishing staples 32. Such lid 28 is shown as being coupled to the shroud 12 by a series of detents 34—one on either side of the shroud—to permit a hinged rotation of the lid 28 upwards toward the head end 16 of the shroud. By composing the lid of a clear plastic construction, for example, a user is able to visualize the staples 32 within the compartment 30, and whatever paper clips, for example, might also be enclosed within. As illustrated in FIGS. 1–3, the staple extractor 26 extends rearwardly of the platform of the second surface 22.

In the top view of FIG. 2, the baseplate of the stapler is shown at 40, the trigger for the stapler is shown at 41, the storage cradle for the typical stapler employed is shown at 42, and the staples retained in the storage compartment is shown at 43. The hinged detents for the storage compartment lid are shown at 44, with the lid itself being shown at 45. Reference numeral 46 identifies the staple/paper clip storage compartment itself, with reference numeral 47 identifying the overall stapler configuration.

Also in the top view of FIG. 2, the staple extractor platform is shown at 48, the hinge pin for the type of stapler shown in FIG. 1 is indicated at 49, and a manner of securing the staple-extractor to the platform 48 is shown as an anchoring rivet 50, although any other appropriate type of securement may be employed. Reference numeral 51 identifies the spring-loaded hinge and pin of this grasp-type staple extractor 26, with reference numeral 52 identifying the thumb trigger of such extractor device.

In the rear view of FIG. 3, the staple extractor 26 is shown in somewhat more detail, with the reference numeral 53 identifying its rivet, and with reference numeral 54 indicating the main hinge pin of the stapler itself. The staple extractor as secured to the platform 24 is once again shown at 26, with the staple storage cradle 42 and storage compartment lid 45 indicated as in FIG. 2. The hinge detent is repeated at 44, along with the stapler mechanism indicated at 48, the stapler baseplate 49 and the staple and paper clip storage compartment at 46. The back of the shroud is once again shown at 18.

Figure 4:
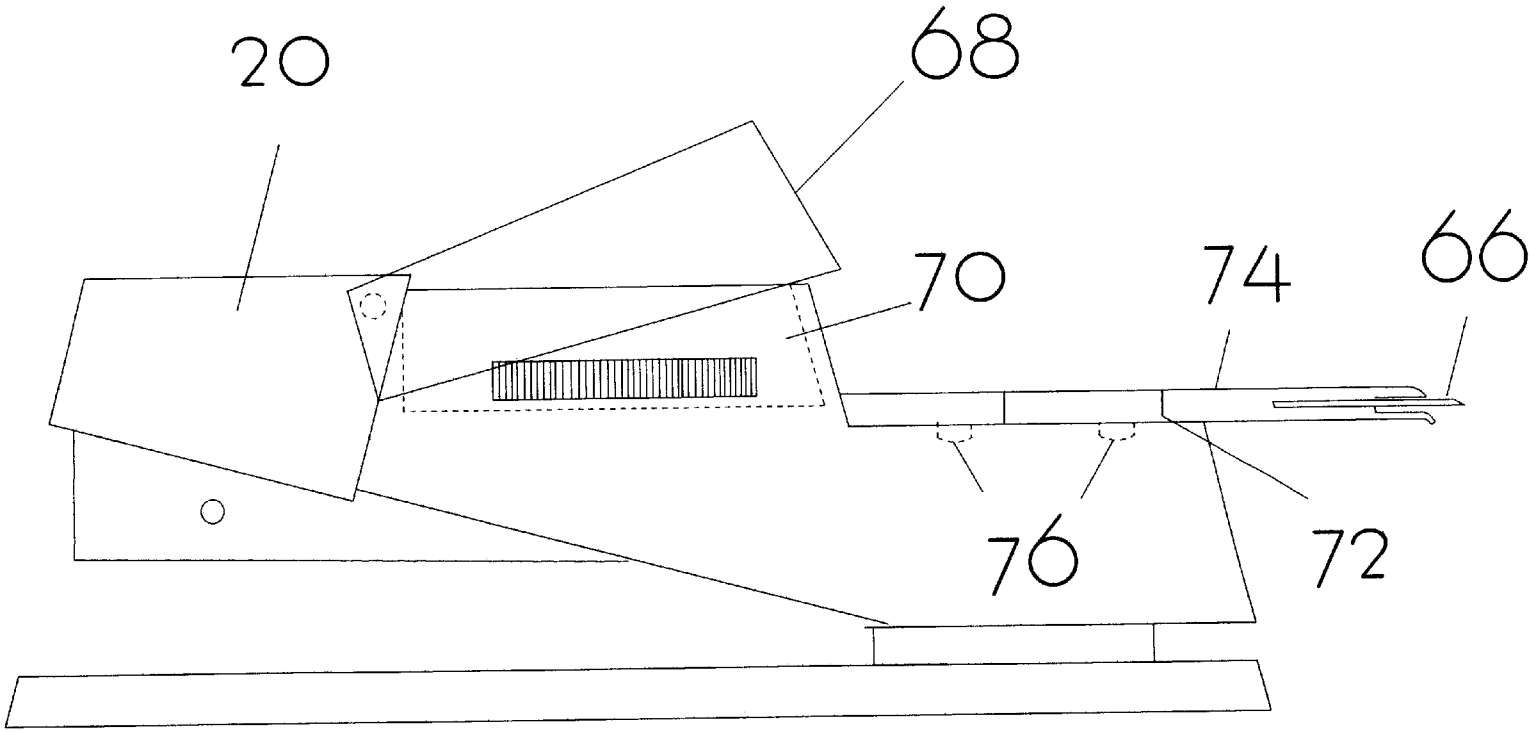
FIGS. 4–6 are perspective, top, and rear views, respectively showing a second embodiment for use with a different type of staple extractor.

As is additionally shown in FIG. 1 (and as will be understood to be shown in the perspective view of FIG. 4), the shroud of the invention 12 includes a third surface 25 underlying the rear of the shroud and a fourth surface 35 which extends at an upwards angle toward the head end 16 of the shroud. In accordance with the invention, such angle is selected preferably at some 30°—to give the overall result that the upwards angle and the planar surface 20 serve to raise the stapler further into the palm of the hand of a user, in adjusting the angle at which the user heretofore grasped the typical stapler when binding sheets of paper together. By moving the shroud towards the meaty portion of the user's palm, an ergonomic advantage follows from the increased articulation of the wrist and thumb.

Figure 5:
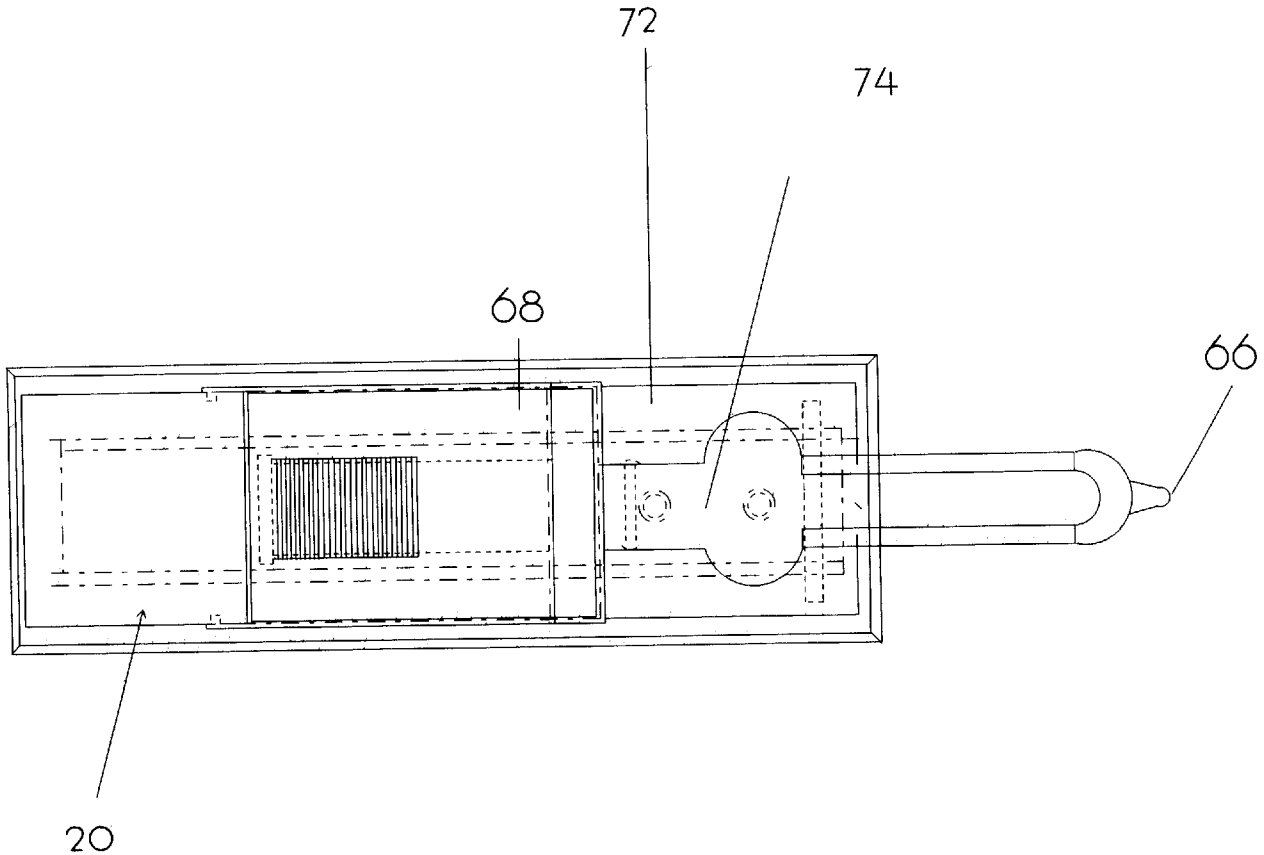
Figure 6:
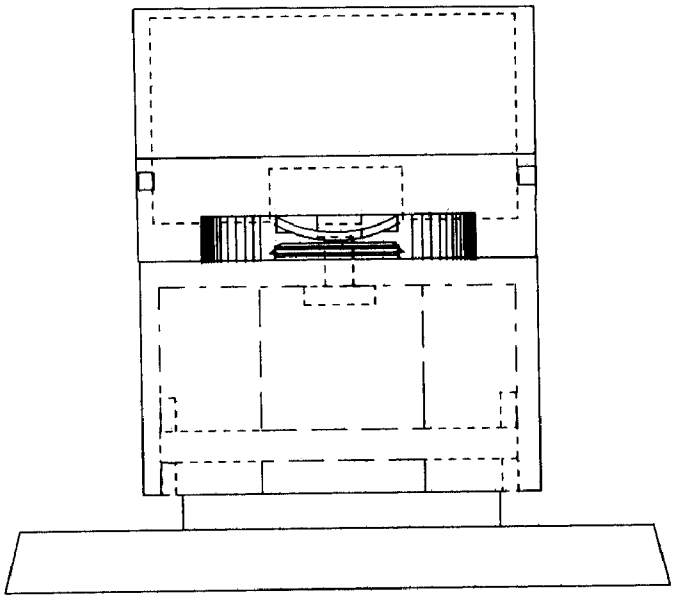

One skilled in the art will realize that the only difference between the views of the second embodiment of FIGS. 4–6 and the first embodiment of FIGS. 1–3 is in the selection of the type of staple extractor employed. In FIGS. 1–3, the grasp-type staple extractor 26 is of a "closable jaw" configuration, biased by a spring towards its open, illustrated position, and actuable by depressing the two sections A, B together to grasp onto a seated staple and pulling upwardly upon it. In FIGS. 4–6, on the other hand, a "push-type", flat staple extractor is shown in which its pry-tip 66 is slid under the seated staple, and actuated to upwardly lift the staple from its secured position. Aside from the differences in the extractor, the teachings of the present invention will be seen to apply equally as well. The clear plastic hinged cover for the storage compartment is shown at 68, the compartment itself within the shroud is shown at 70, and the platform on which the extractor 74 is secured and extends rearwardly thereof is shown at 72. The "push-type" extractor 74 may be secured to the platform 72 by rivets 76.

While there have been described what are considered to be preferred embodiments of the present invention, it will be readily appreciated by those skilled in the art that modifications can be made without departing from the scope of the teachings herein. Thus, while the invention has been described in the context of having the staple shroud constructed to have a pair of planar surfaces in forming a platform from which the staple extractor extends, it will be recognized that a similar teaching of providing a secured extractor and an included storage compartment could follow equally as well in those constructions where the stapler extractor is just simply secured to the shroud (i.e., as at and to its first surface), and continues to extend rearwardly beyond the back end of the shroud. In such arrangement, the incorporation of a second surface as a platform may not be required—namely, for those constructions where it is desired to eliminate the feature of the included staple storage compartment. When such staple storage compartment is omitted, the securement of the staple extractor is to the first surface of the shroud, however with the advantages of the invention still continuing of having a one-piece combination which is ergonomically comfortable in use. While the concept of having an included storage compartment is highly desirable, the recognition follows that the features of the invention are present, even in this cut-back version. For at least such reason, resort should be had to the claims appended hereto for a true understanding of the invention.

We claim:

1. In a stapler of the type having a shroud, a baseplate, a head end at said shroud containing a staple trigger, a back end at said shroud coupled to said baseplate, and a magazine assembly coupled with said shroud and loaded with staples to be slidably pushed towards said head end of said shroud by a tensioned coil spring within said magazine, the improvement comprising said shroud having a first planar surface extending rearwardly from said head end at a height $H_1$ above said baseplate, a second planar surface extending forwardly from said back end at a lesser height $H_2$ above said baseplate, a wall joining said first and second planar surfaces in providing a rearwardly facing platform on said shroud, and a staple extractor secured to said platform extending rearwardly beyond said back end of said shroud.

2. The improvement of claim 1 wherein said first and second planar surfaces extend generally horizontally with respect to said head end and said back end of said shroud, respectively.

3. The improvement of claim 1 wherein said first planar surface extends rearwardly from said head end a length $L_1$, greater than a length $L_2$ by which said second planar surface extends forwardly from said back end.

4. The improvement of claim 3 wherein said first planar surface extends rearwardly from said head end a length substantially twice as great as the length by which said second planar surface extends forwardly from said back end.

5. The improvement of claim 1 wherein said shroud includes a staple storage compartment beneath a portion of said first planar surface.

6. The improvement of claim 5 wherein there is also included a lid overlying said staple storage compartment and hinged for openable rotation towards said head end of said shroud.

7. The improvement of claim 1 wherein said shroud also includes a third surface underlying said back end and a fourth surface extending at an upwards angle therefrom towards said head end of said shroud.

8. The improvement of claim 7 wherein said fourth surface extends at an upwards angle of substantially 30° towards said head end of said shroud.

9. In a stapler of the type having a shroud, a baseplate, a head end at said shroud containing a staple trigger, a back end at said shroud coupled to said baseplate, and a magazine assembly coupled with said shroud and loaded with staples to be slidably pushed towards said head end of said shroud by a tensioned coil spring within said magazine, said shroud having a first planar surface extending rearwardly from said head end, and a staple extractor secured to said first planar surface extending rearwardly beyond said back end.

10. The improvement of claim 9 wherein said shroud also includes a second surface underlying said back end and a third surface extending at an upwards angle from said second surface at substantially 30° towards said head end of said shroud.

* * * * *